US006802138B2

(12) United States Patent
McManus et al.

(10) Patent No.: US 6,802,138 B2
(45) Date of Patent: Oct. 12, 2004

(54) CUSHIONING SYSTEM FOR FOOTWEAR AND RELATED METHOD OF MANUFACTURE

(75) Inventors: Ronald P. McManus, Kentwood, MI (US); William J. Brown, Ada, MI (US); Gary L. Sikes, Taipa (MO)

(73) Assignee: Wolverine World Wide, Inc., Rockford, MI (US)

( * ) Notice: Subject to any disclaimer, the term of this patent is extended or adjusted under 35 U.S.C. 154(b) by 128 days.

(21) Appl. No.: 10/071,303

(22) Filed: Feb. 8, 2002

(65) Prior Publication Data

US 2003/0150131 A1 Aug. 14, 2003

(51) Int. Cl.[7] ..... A43B 13/18; A43B 13/38; A43B 23/00

(52) U.S. Cl. ..... 36/28; 36/44; 36/17 R; 36/30 R

(58) Field of Search ..... 36/3 B, 44, 17 R, 36/28, 30 R

(56) References Cited

U.S. PATENT DOCUMENTS

| | | | | |
|---|---|---|---|---|
| 1,559,532 A | | 10/1925 | Smith | |
| 1,717,122 A | | 6/1929 | Schaff | |
| 1,718,906 A | | 6/1929 | Hurley | |
| 1,724,349 A | | 8/1929 | Haag | |
| 1,781,715 A | | 11/1930 | Blakely | |
| 1,973,105 A | | 9/1934 | Rohn et al. | |
| 1,993,208 A | | 3/1935 | Cohn | |
| 2,139,260 A | | 12/1938 | Cuozzo | |
| 2,529,034 A | * | 11/1950 | Lipton | 36/44 |
| 2,607,061 A | | 8/1952 | Leahy et al. | |
| 3,005,272 A | | 10/1961 | Shelare et al. | |
| 3,006,085 A | | 10/1961 | Bingham, Jr. | |
| 3,834,046 A | * | 9/1974 | Fowler | 36/30 R |
| 4,120,102 A | | 10/1978 | Kenigson | |
| 4,610,099 A | * | 9/1986 | Signori | 36/3 B |
| 4,654,982 A | * | 4/1987 | Lee | 36/3 B |

(List continued on next page.)

FOREIGN PATENT DOCUMENTS

| | | |
|---|---|---|
| DE | 51380 | 12/1911 |
| EP | 0202713 A1 | 5/1986 |
| EP | 0334038 | 2/1989 |
| EP | 1166671 | 5/2001 |
| FR | 2469141 | 5/1981 |
| FR | 2594305 | 8/1987 |
| GB | 2086710 | 11/1981 |
| WO | WO 8102969 | 10/1981 |

OTHER PUBLICATIONS

US 4,974,345, 12/1990, Yung-Mao (withdrawn)

*Primary Examiner*—Anthony D. Stashick
(74) *Attorney, Agent, or Firm*—Warner Norcross & Judd

(57) ABSTRACT

A footwear cushioning system including an insole platform and an insert that cooperate with one another. The insole platform includes a recess defined in the heel and/or forefoot area. The insert includes a footbed and heel and/or forefoot cushion extending from the footbed. The cushions interfit with the respective heel and/or forefoot recess of the insole platform. In a preferred embodiment, the insole platform includes a shank secured thereto, surrounding the heel recess. The insole platform is preferably shaped to define both heel and forefoot recesses and the insert includes cushions that interfit with both recesses. A midsole is secured to the insole platform and an outsole is further secured to the midsole. To assemble the cushion system, the insole platform is secured to the upper. The midsole is then secured to the insole platform. The outsole is adhered to the under surface of the midsole. The insert is fitted into the upper over the insole platform so that the heel and/or sole cushions rest within the corresponding heel and/or sole recesses of the insole platform.

23 Claims, 7 Drawing Sheets

U.S. PATENT DOCUMENTS 4,783,910 A * 11/1988 Boys, II et al. ..... 36/30 R
4,843,741 A 7/1989 Yung-Mao
4,845,863 A 7/1989 Yung-Mao
5,068,983 A * 12/1991 Marc ..... 36/44
5,179,791 A 1/1993 Lain
5,311,677 A 5/1994 Mann et al.
5,435,078 A 7/1995 Pyle
5,542,195 A 8/1996 Sessa
5,768,801 A * 6/1998 Huff ..... 36/17 R
5,775,005 A * 7/1998 McClelland ..... 36/28
5,815,949 A * 10/1998 Sessa ..... 36/3 B
5,911,491 A * 6/1999 Huff ..... 36/17 R
6,145,220 A 11/2000 Johnson, Jr. et al.
6,226,895 B1 * 5/2001 McClelland ..... 36/17 R
6,574,886 B1 * 6/2003 Issler ..... 36/28
6,581,305 B2 * 6/2003 Ho ..... 36/17 R

* cited by examiner

CUSHIONING SYSTEM FOR FOOTWEAR AND RELATED METHOD OF MANUFACTURE

BACKGROUND

The present invention relates to footwear and, more particularly, to a footwear construction and a method for making the same.

In the footwear industry, there is an ongoing effort to produce footwear including a cushioning system that provides a high level of comfort for wearers. The need to produce such a cushioning system is particularly pronounced in the design of work, walking and athletic footwear, where increased cushioning is a primary objective. For example, to minimize the effects of standing and walking on hard surfaces (e.g., concrete floors), it is desirable to provide footwear that cushions the wearer's foot, particularly the heel, from the hard surface.

Many conventional cushioning systems are presently in use. In simple systems, a foam layer of varying thickness is either (1) adhered directly to an insole of a shoe before the shoe is assembled or (2) added as a footbed after the shoe is assembled. Another system incorporates a cushion disposed over the insole in a specific area, such as the heel, which typically experiences the most impact during walking. A problem with these systems, however, is that an increase in the size of the upper to accommodate the added cushion is required. This often results in a distorted looking upper or shoe, increased in size to accommodate the cushion, that is loose fitting.

One solution to these problems is disclosed in U.S. Pat. No. 6,145,220 to Johnson, Jr., which avoids adding bulky cushion layers by using a specialized heel plug or cushion disposed in a cavity perforated through shoe components in the heel area. The cavity is cut completely through the insole, midsole and outsole to accommodate the heel plug. The shank of the Johnson shoe also includes a hole corresponding to the cavity. This structure increases cushioning and maintains a low shoe profile, however, its manufacture is complicated and costly. To ensure that the different layers around the cavity remain intact, nails are used. The nails are positioned in a precise pattern to prevent them from extending into the heel cavity, where they may impede insertion of the heel plug into that cavity. After continued use, the nails holding the layers together also have a tendency to release, thereby allowing the layers to delaminate around the heel cavity. Additionally, each layer must be precisely sized and perforated to accommodate the heel plug. Furthermore, the heel plug of Johnson moves relative to the insole, the outsole and the heel of the shoe to add cushioning, but in some cases too much cushioning. As a result, the cushioning movement of the heel plug may reduce support in the shoe and make the shoe feel unstable.

Although the cushioning systems of the prior art provide cushioning, there remains a long felt and unmet need for an easily manufactured footwear construction that provides a desired level of cushioning over the life of the footwear.

SUMMARY OF THE INVENTION

The aforementioned problems are overcome in the present invention that provides an insole platform that is shaped to define an integral heel recess. A cushion insert including a heel cushion extending therefrom is disposed over the insole platform so that the heel cushion fits into and substantially fills the heel recess.

In another embodiment, the insole platform is shaped to define an integral recess in the forefoot portion, and the insert includes a corresponding sole cushion extending from it that fits into and substantially fills the sole recess. A transverse member, integral with the insole platform, separates the heel and sole recesses.

In a third embodiment, the insole platform includes a shank secured to the insole, around the heel recess. The shank preferably extends partially into the heel recess and across a portion of the transverse member to add rigidity and torsion strength to the insole platform and consequently the shoe. The shank also is preferably integrally attached to the insole platform as the insole platform is manufactured, for example, by insert molding. The shank preferably includes inclined shank walls, extending into the heel recess to center a wearer's heel in the recess.

In another embodiment, the insole platform is secured to an upper with a rib extending from the insole platform. A welt is attached around the insole platform to the rib as well. A midsole is secured to the welt, and an outsole is further secured to the welt and midsole. The outsole includes upwardly opening recesses in the forefoot and heel portions. Cushion plugs may be separately manufactured and inserted in these recesses or may be molded directly in the outsole to provide additional cushioning.

A footwear assembly of the present invention is preferably manufactured using the general steps of (a) securing an insole platform to an upper, the insole platform being shaped to define a recess; (b) securing a midsole and/or an outsole to the undersurface of the insole platform; and (c) fitting a cushioning insert into the upper positioned over the insole platform, the insert including a cushion that fits in the corresponding recess in the insole platform.

The present invention provides a novel footwear construction including a low profile cushioning system. The interaction of the recessed insole platform with the cushion of the insert in the heel eliminates the need for a heel plug extending through the insole, midsole and outsole. Without a heel plug cavity, the need for precisely perforating and nailing multiple layers of the sole assembly around the cavity is obviated. Additionally, the stability and support of the footwear is uncompromised with the added cushion. Specifically, the heel cushion of the insert interfits directly in the heel recess of the insole to avoid movement relative to multiple components of the shoe. Furthermore, the integrally molded shank around the heel recess of the insole platform provides an exceptional, torsion-resistant platform to prevent lateral strain on the ankles of a wearer and improve the rigidity of the footwear. Moreover, footwear incorporating the insole platform may be assembled without securing together all the layers of the sole—the insole, midsole, and outsole—with fasteners such as nails.

These and other objects, advantages and features of the invention will be more readily understood and appreciated by reference to the detailed description of the preferred embodiments and the drawings.

DETAILED DESCRIPTION OF THE PREFERRED EMBODIMENTS

Figure 1:
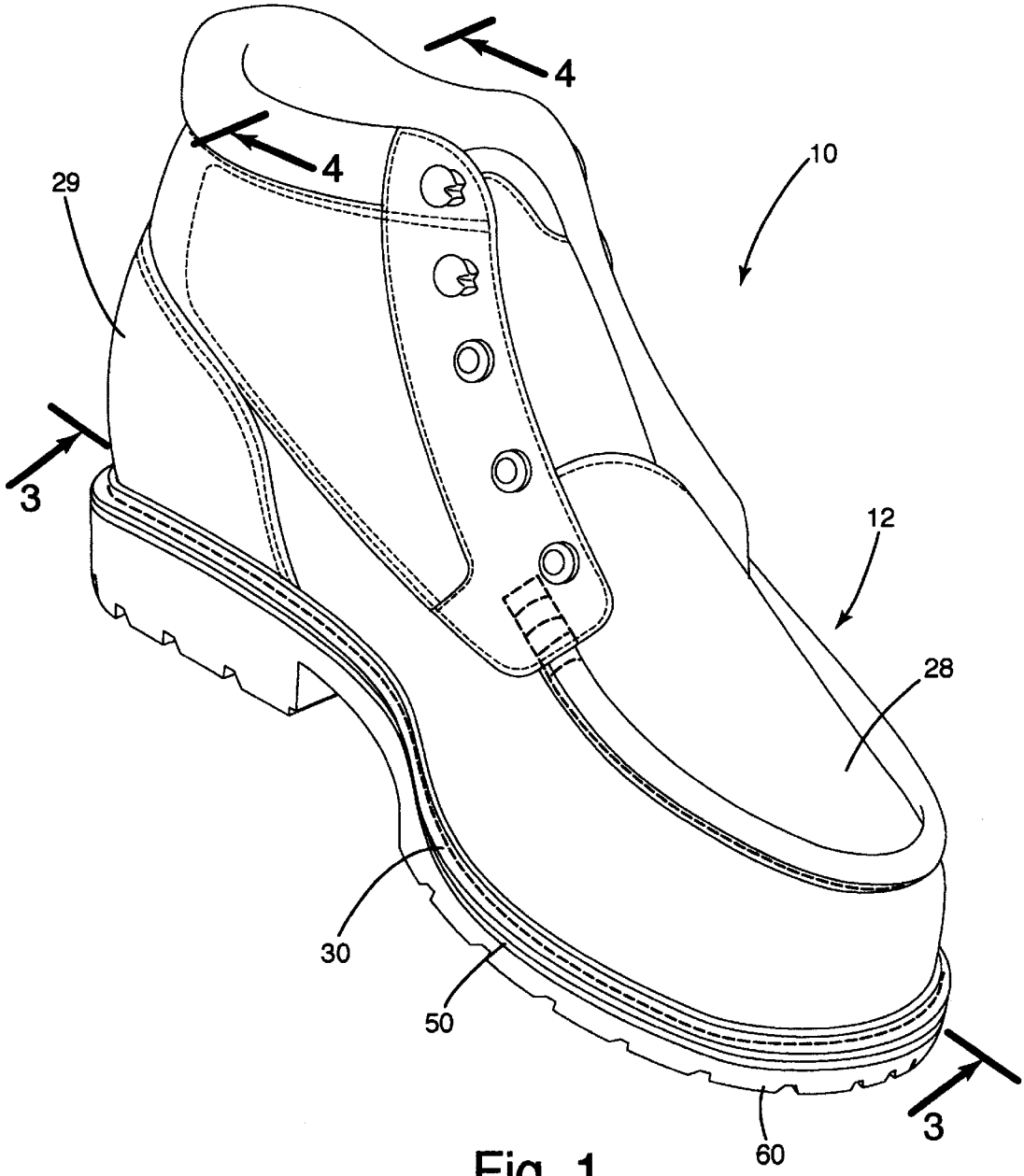
FIG. 1 is a perspective view of an article of footwear incorporating the present invention.

A boot constructed in accordance with a preferred embodiment of the present invention is shown in FIGS. 1–4 and generally designated 10. For purposes of disclosure, the present invention will be described in connection with a conventional three-quarter height boot. As will be appreciated, the present invention is well suited for use with other types of soled footwear.

Generally, the boot 10 includes an upper 12, insert 80, insole platform 40, midsole 50 and outsole 60. The upper 12 is secured to the insole platform 40, which is secured to the midsole 50. The insert 80 fits over the insole platform 40. The midsole 50 further is secured to the outsole 60. The welt 30 is attached to and interconnects the upper 12, the insole platform 40 and the midsole 50.

The upper 12 is conventional and will only be described briefly here. Upper 12 includes a quarter 29 and a vamp 28. The upper 12 terminates in the lower peripheral edge 26, which is attached to the insole platform 40 through the welt 30 as described in detail below. The upper 12 is preferably manufactured from leather, canvas, nylon or other suitable materials, and may include a liner (not shown) or other conventional accessories.

Figure 3:
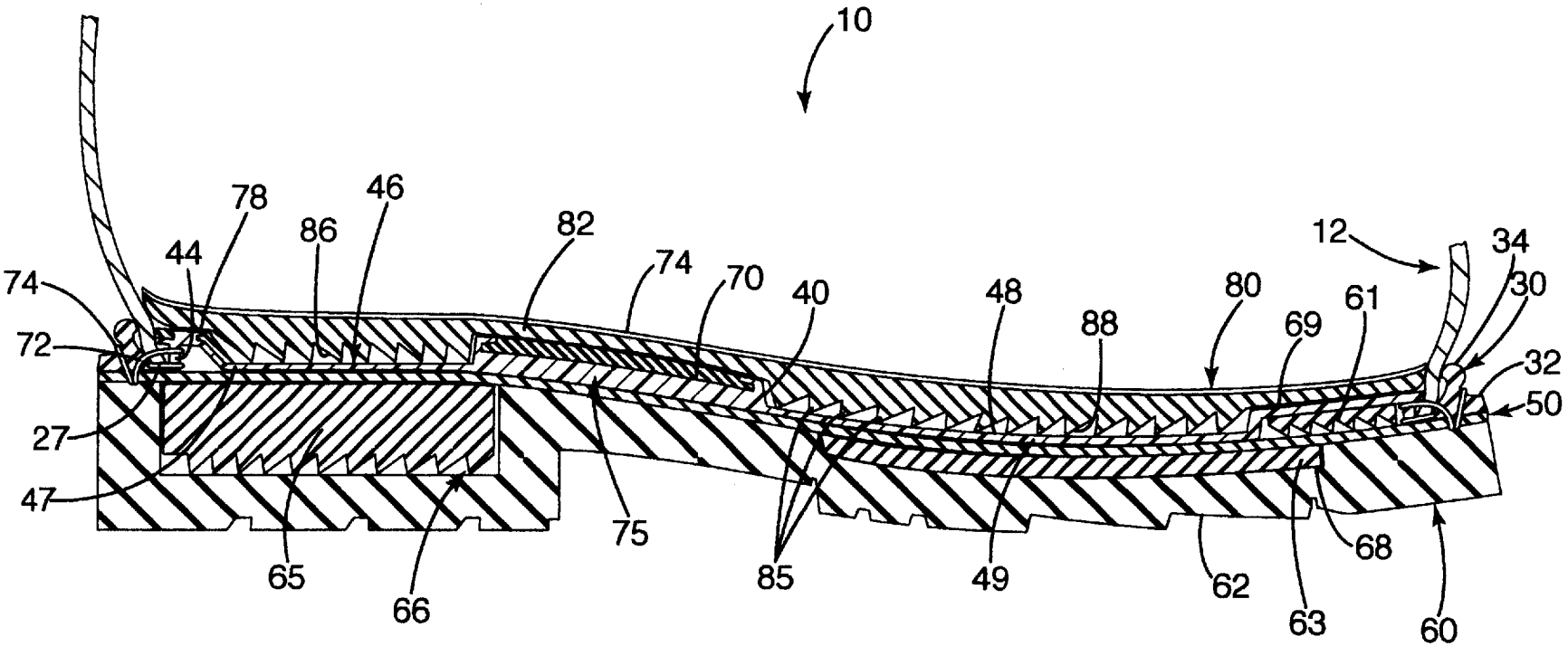
FIG. 3 is a sectional view of the footwear taken along line 3—3 of FIG. 1.
Figure 4:
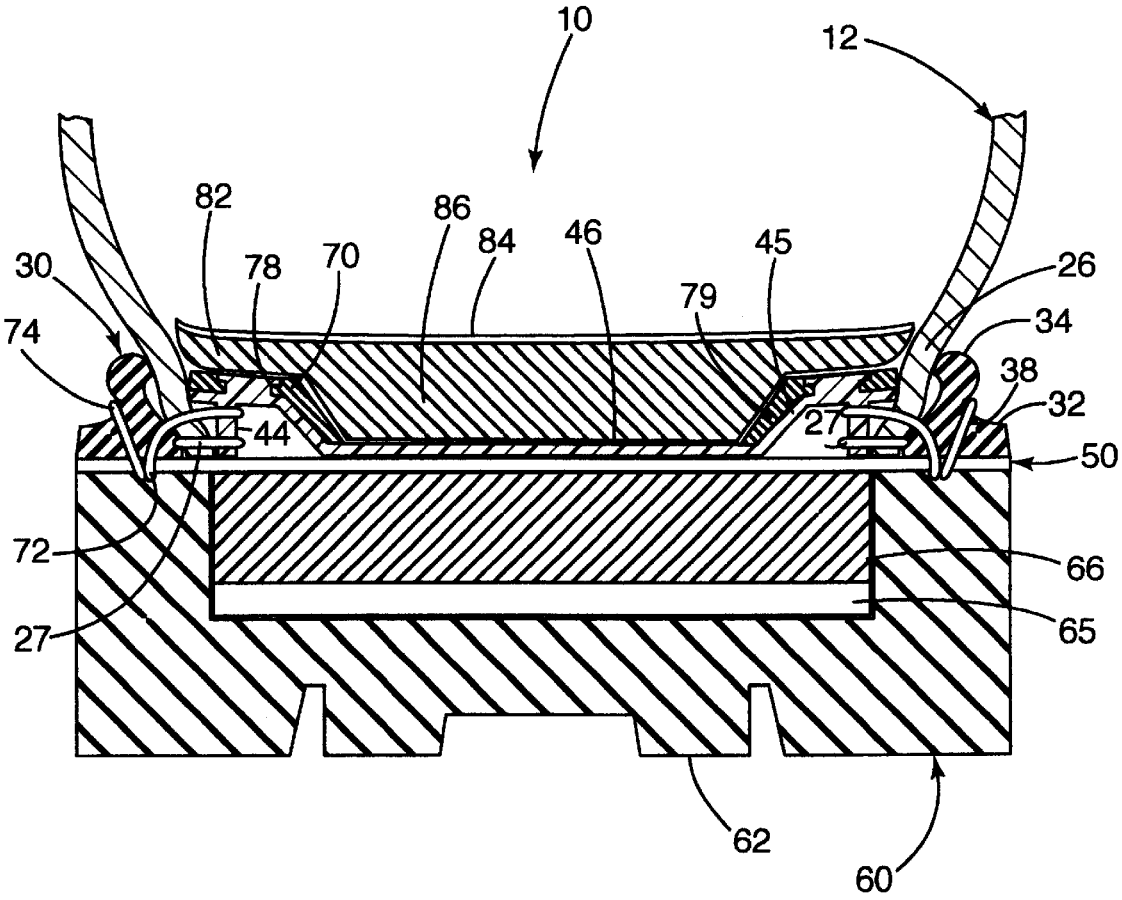
FIG. 4 is a sectional view of the footwear taken along line 4—4 of FIG. 1.

As best shown in FIGS. 3 and 4, the welt 30 extends entirely around the boot 10 to interconnect the upper 12, the insole platform 40 and the midsole 50. The welt 30 is generally conventional, including a generally horizontal base portion 32 with an upwardly extending upper rib 34 located toward the center of the base portion 32. The outer surface of the upper rib 34 is rounded to, among other things, reduce the profile of the welt 30. The inner surface of the horizontal base portion 32 is generally tapered in cross section and is of sufficient size to receive staples, stitching or other fastening elements. The horizontal base portion 32 defines an upwardly opening stitch grove 38 that extends around the welt 30 near its outer edge. The stitch grove 38 is adapted to receive stitching 74 that interconnects the midsole 50 and welt 30 as described in more detail below. Optionally, the stitching 74 and stitch grove 38 may be absent from the footwear as desired, with only stitching 74 connecting the insole platform 40 and upper 12 to the midsole 50.

The insert 80 generally includes heel cushion, or element, 86 and sole cushion 88 extending from the insert base 82. The insert base 82 is configured to outline the shape of a foot and cradle the foot. The insert base may include a sock liner 84 attached to it and vents 87 to improve the circulation of air in the shoe 10. The heel cushion 86 and sole cushion 88 are designed to interfit the heel recess 46 and sole recess 48 respectively as described in further detail below. As shown, the heel cushion 86 includes multiple triangular-shaped ribs 85. These ribs 85 are preferably forwardly inclined from the vertical. The sole cushion 88 includes similar ribs, but rearwardly inclined from the vertical.

The insole platform 40 includes a base or plate 42 with a downwardly extending rib 44. The insole base 42 is generally planar and corresponds in shape with an outline of a foot. The insole rib 44 extends downwardly and around the insole base 42 at or near its outer edge or periphery. The insole rib is of sufficient size to receive staples, stitching or other fastening elements. The insole rib 44 interconnects the insole plate 40 to the upper 12, the welt 30, and the midsole.

The insole base 40 defines a heel recess 46 extending downwardly the heel area of the shoe 10. The heel recess is bounded by a bottom wall 47 and side wall 45. Additional side walls may be included as desired to alter the configuration of the recess. The insole base optionally includes a sole recess 48 in the forefoot portion of the shoe. The sole recess is bounded by a bottom wall 43 and side walls 49, which may vary in number depending on the desired configuration of the sole recess. The heel recess 46 and sole recess 48 extend downwardly from the insole base a depth substantially equal to the insole rib 44, or any other depth as desired.

Figure 5:
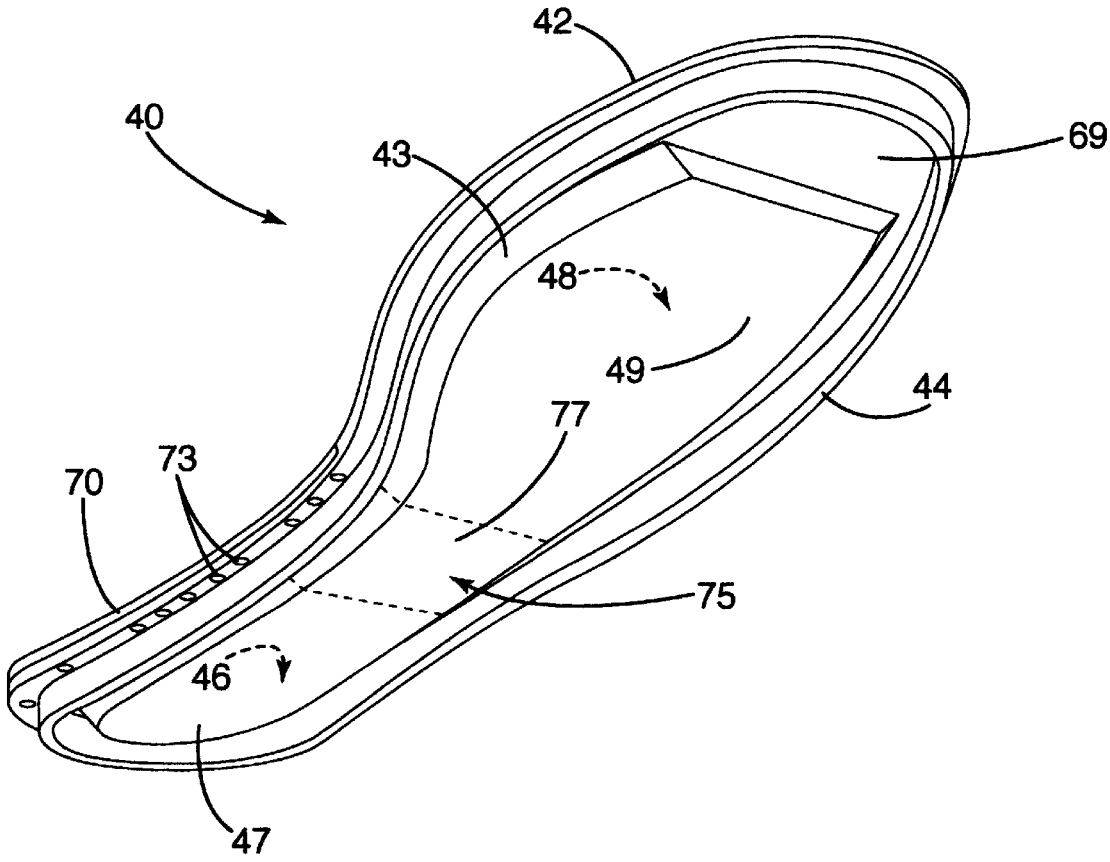
FIG. 5 is a lower perspective view of an insole platform of the footwear.
Figure 7:
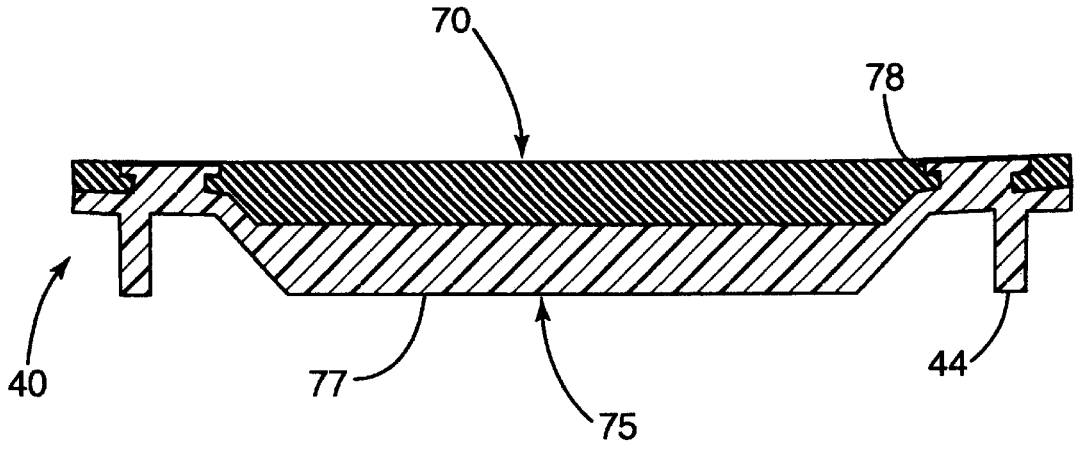
FIG. 7 is a sectional view of the insole platform taken along line 7–7 of FIG. 6.

With further reference to FIGS. 3, 5 and 7, the sole recess 48 and heel recess 46 are separated by a transverse member 75. The transverse member includes a bottom surface 77 that is substantially in the same plane as the lower surfaces of the bottom walls 47, 49 of the heel 46 and sole 48 recesses. The transverse member is preferably of sufficient thickness to add torsion strength and rigidity to the insole platform. As shown, the transverse member extends a portion of the depth between the lower surfaces of the bottom walls 47, 49 and the insole base 42, with the remainder of the depth occupied by the shank 70 as explained in more detail below.

As best shown in FIGS. 5 and 7, the transverse member 75 extends across a center portion of the width of the foot between the insole rib 44 on opposite sides of the insole platform, however, the transverse member optionally may extend and connect the insole rib on opposite sides of the insole platform as desired. The transverse member is preferably an integrally molded part of the insole platform, but may also be interconnected to the insole platform in a conventional manner.

The insole platform 40 preferably is constructed from polyvinyl chloride, but other materials, such as polymers, rubber or other synthetic materials alternatively may used. Additionally, the surfaces of all or selected components of the insole platform may be textured to improve the adhesion of cements and adhesives thereto.

Figure 6:
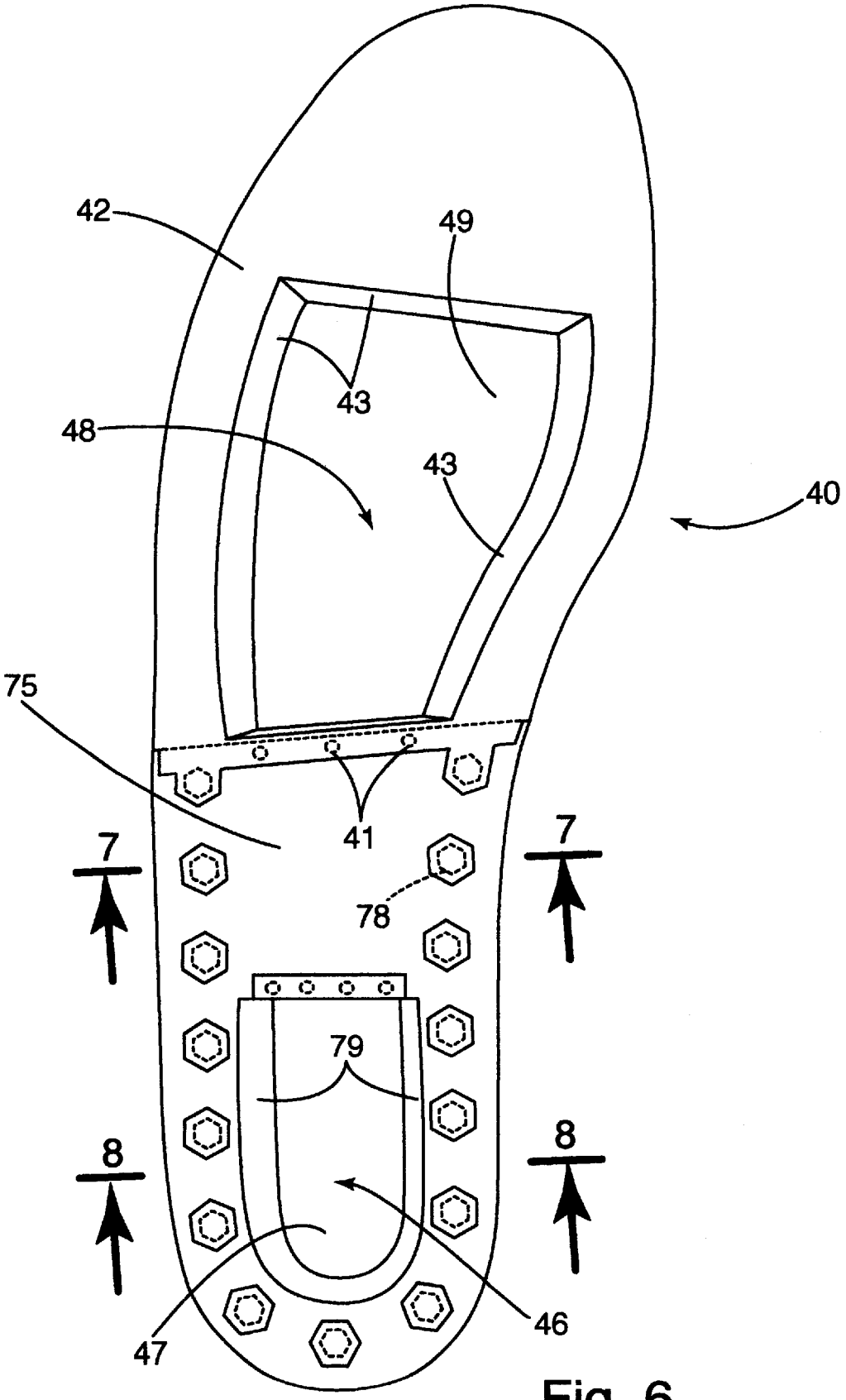
FIG. 6 is a top view of the insole platform.
Figure 8:
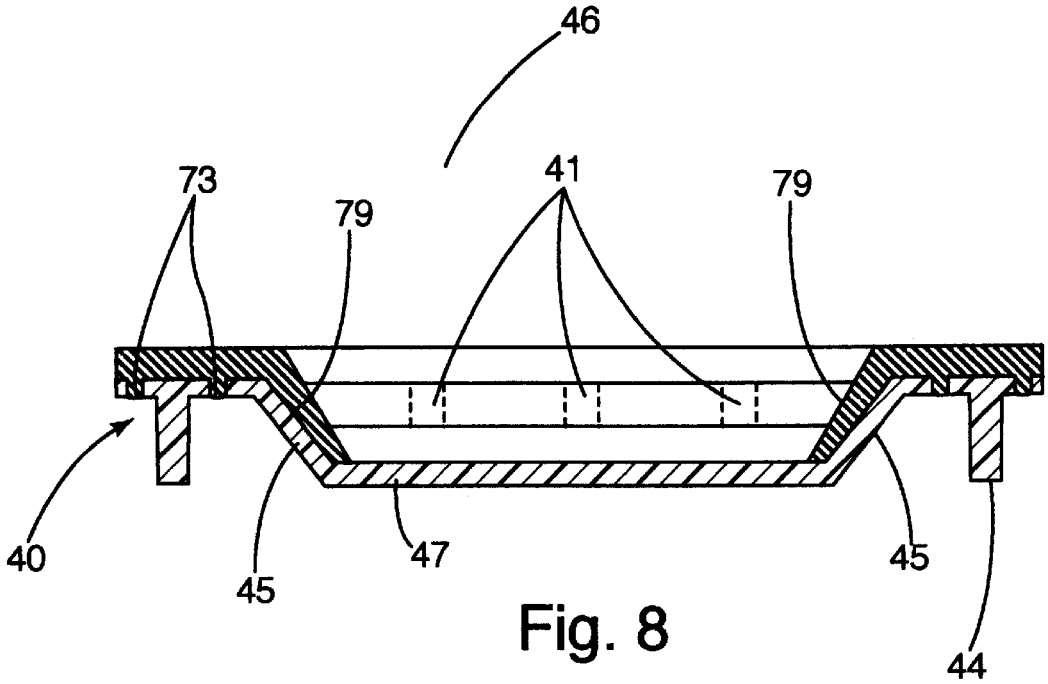
FIG. 8 is a sectional view of the insole platform taken along line 8–8 of FIG. 6.

As best shown in FIGS. 6, 7 and 8, the footwear 10 also includes a shank 70, which is included in the insole platform 40. The shank 70 extends across the transverse member 75, preferably across the width of the insole platform. Although depicted as covering the entire transverse member, the shank may cover only a portion of the transverse member between the heel recess 46 and sole recess 48 as desired. The shank is preferably of a unitary construction that surrounds the heel recess to add torsion strength in the heel region and/or rigidity to the footwear 10.

As shown in FIGS. 4 and 8, the shank 70 may include shank recess walls 79 which extend down the side walls 45 of the heel recess 46, terminating at or near the heel recess bottom wall 47. The shank recess walls 79 and sidewalls 45 of the recess are preferably inclined from the vertical as shown to center a wearer's heel as the wearer applies a downward force on the insert 80, forcing the heel cushion 86 into the heel recess 46.

The shank may also include mold cores 78 and/or shank cores 41 that enhance attachment of the shank to the insole platform 40. For example, the mold cores 78 allow the material from which the insole platform 40 is molded to seep into them during molding. When the insole platform material cures, the interaction of the insole platform material and the mold cores 78 provide a mechanical bond between the shank 70 and the insole platform 40. This mechanical bond is helpful where the insole platform material and shank material do not bond well to one another. As will be appreciated, where the insole platform material and the shank material bond well, the cores may be reduced in number or eliminated. Additionally, the shank may include positioning pins 73 to assist locating the shank 70 on the insole platform 40 and hold the two in fixed relation.

The shank 70 is preferably constructed from polystyrene, but may be constructed from other plastic, metal or synthetic materials that may be secured to the insole platform 40 to add rigidity to the shoe 10 as desired.

Figure 2:
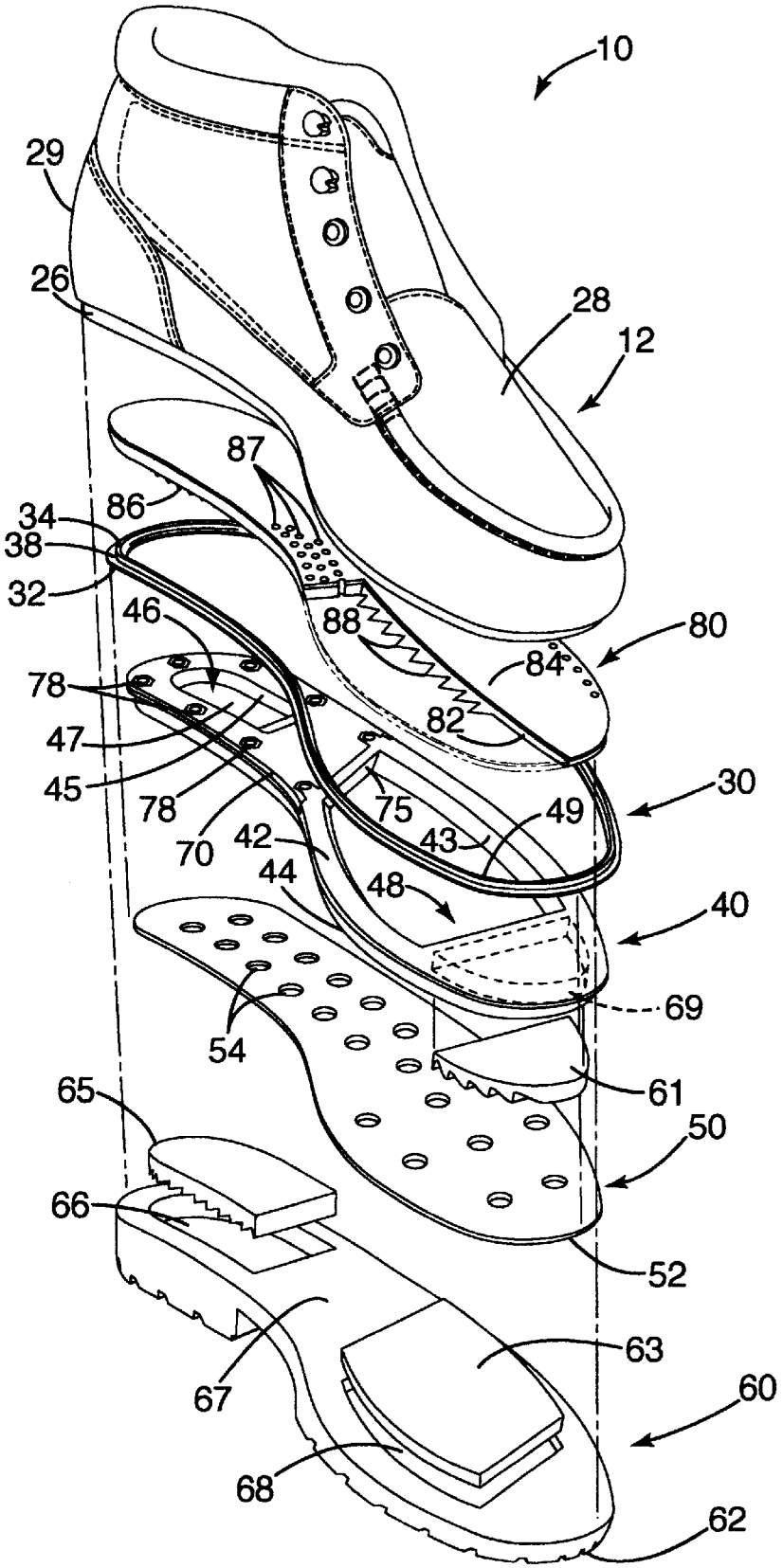
FIG. 2 is an exploded perspective view of the article of footwear.

With reference to FIGS. 2, 3 and 5, the sole recess 48 terminates short of the front of the insole platform 40 to define a toe cushion recess 69 bounded in part by a portion of the insole rib 44 and a side wall 43 of the sole recess 48. A toe cushion 61 preferably is disposed in the toe cushion recess 69 to add cushioning in the toe region of the shoe 10. The toe cushion as shown includes a plurality of transverse ribs, preferably forwardly inclined from the vertical and extending across a the width of the toe cushion 61. The transverse ribs may be rearwardly inclined from the vertical if desired. Furthermore, the toe cushion 61 may be of uniform, solid construction or a dual/multiple density construction.

FIGS. 3 and 4 show the interconnecting of the upper 12 to the insole platform 40 and the interconnecting of the insole platform 40, the upper 12, and the welt 30 to the midsole 50. The upper 12 is secured to the insole platform rib 44 with staples 27. As will be appreciated, other fastening means may be used such as stitching and adhesives may be used. The stitching 72 interconnects the insole platform rib 44 to the upper 12, welt 30 and midsole 50. Additional stitching 74 within groove 38 also connects the welt 30 to the midsole 60. The insole platform 40 may be further secured to the midsole 50 with adhesive as desired.

The midsole 50 generally includes a midsole base 52 which is generally of a planar or sheet construction and corresponds in shape with the outline of the foot. The midsole base optionally includes a plurality of midsole apertures 54 to enhance air flow out from outsole 60 and increase cushioning. The midsole 50 preferably is constructed from rubber, plastic or other synthetic or natural materials. The midsole is further secured to the outsole 60 with a suitable adhesive or other fastening means such as stitching.

The outsole 60 generally includes a outer surface 62, outsole top surface 67, heel cavity 66 and sole cavity 68. The outer surface 62 may be contoured to define the desired heel and tread patterns. The outer surface 62 may also be textured as desired to improve the traction and esthetic appeal of the footwear. The outsole 60 is preferably manufactured from a relatively hard rubber or other sufficiently durable and wear-resistant material, for example, polyurethane, polyvinyl chloride, or thermoplastic rubber.

The heel cavity 66 and sole cavity 68 have disposed therein heel pad 65 and sole pad 63 positioned therein to increase the cushion characteristics of the outsole 60. The sole pad 63 and heel pad 65 are preferably the same depth as the sole cavity 68 and heel cavity 66 respectively. The sole pad 63 is shown as including a uniform solid construction, but may include other cushioning structure, for example transverse ribs like those of the toe cushion pad described above. The heel pad 65 preferably includes transverse ribs configured to incline rearwardly from the vertical. As will be appreciated, the heel pad may be of uniform solid or other construction as desired.

The pads in the heel and sole may be of a variety of constructions, sizes and materials. For example, the pads may be integrally molded into the outsole 60 as part of a dual-density outsole. The outsole pads may be of varying sizes as desired.

The insert 80, toe cushion 61, outsole heel 65 and sole 63 pads are constructed from ethyl vinyl acetate (EVA), and alternatively polyurethane, or other conventional cushioning materials.

Manufacture and Assembly

The boot 10 is manufactured using generally conventional machinery. Below is a description of the manufacture of each of the components of the boot 10 followed by a description of the assembly of the components to form the boot 10.

The upper 12 is manufactured using generally conventional techniques and apparatus. The desired upper material (not shown) is cut to form the various elements of the upper, including the vamp 28 and quarter 29. The elements of the upper are then fitted and sewn together using conventional methods and apparatus. A lining (not shown) may be sewn within the upper during the fitting step.

The insert 80 is manufactured using conventional molding techniques and apparatus, for example, the insert may be injection or pour molded from EVA or foam. The welt 30 is manufactured using conventional techniques and apparatus. For example, the welt 30 can be extruded from hard durable rubber.

The insole platform 40 is manufactured using injection mold techniques. A conventional two-part mold (not shown) including interior surfaces corresponding to the components of the insole platform 40 is provided. A pre-molded shank 70 is disposed in one of the mold parts adjacent in the heel region. As noted above, the shank 70 preferably includes mold cores 78, positioning pins 73 and shank cores 41. The mold parts are closed and the insole platform material is introduced into the mold cavity (not shown). As the material is introduced, it seeps into the mold cores 78, and shank cores 41 and forms around the positioning pins 73 to create a mechanical bond between the shank 70 and molded insole platform 40. The completed insole platform 40 with attached shank 70 is removed from the mold.

The midsole 50 is manufactured using conventional techniques and apparatus. For example, the midsole is die cut from a sheet of rubber or other material in the shape of a foot.

The outsole 60 preferably is injection or pour molded to form a flexible yet durable outsole using conventional molding apparatus. Preferably, the wear surface 62, sole cavity 68 and heel cavity 66 are all formed during the molding operation to form an integral part of the outsole 60. Pre-manufactured heel pad 65 and sole pad 63 are positioned in the respective heel cavity 66 and sole cavity 68, and may be cemented, fused, or otherwise secured therein as desired. Optionally, the outsole 60 may be dual-density molded, with the regions generally corresponding to the heel cavity 66 and sole cavity 68 molded with a material of a different density, preferably less dense, than the remainder of the outsole.

To begin assembly of components to form the boot 10, the fitted upper 12 is stretched over a last (not shown). The insole platform 40 is placed within the lower peripheral edge 26 of the upper using conventional apparatus and techniques. The insole platform rib 44 is stapled directly to the lower peripheral edge 26 with staples 27. Alternatively, insole rib 44 can be sewn, glued or otherwise attached to the upper 12 in a conventional manner.

With the upper 12 is lasted to the insole platform 40, the welt 30 and midsole 50 are attached to the upper 12 and insole platform 40. Specifically, the inner surface of the horizontal base portion 32 and the midsole 50 are stitched around the peripheral edge 26 of the upper 12 and the insole platform rib 44 using conventional apparatus and techniques. This rib stitch 72 preferably extends through the horizontal base portion 32, the lower peripheral edge 26 of the upper 12, the insole rib 44 and the midsole 50. Another welt stitch 74, positioned within stitch groove 38 further secures the horizontal base portion to the midsole 50. If desired, the insole platform 40 or other sole component can be cemented to the midsole 50 using conventional adhesive, cementing or fusing techniques. Preferably, the toe cushion 61 is positioned in the toe cushion cavity 69 before the midsole is secured to the upper and insole platform. The toe cushion may be loose, or cemented, or otherwise secured in a conventional manner to the insole platform cushion cavity and midsole as desired.

The outsole 60 is cemented, fused or otherwise secured to the midsole 50 using conventional techniques and apparatus. With the sole assembly and components secured to the upper, the insert 80 is positioned in the footwear 10, over the insole platform so that the sole 88 and heel 86 cushions interfit with the sole 48 and heel 46 recesses respectively. The insert may be cemented or otherwise secured to the insole platform as desired.

Finally, a number of conventional finishing operations are performed on the boot 10. For example, the edge of the outsole 60 is trimmed and shaped; the upper 12 is cleaned, polished and treated as appropriate and necessary; and the laces are inserted in the eyelets.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

What is claimed is:

1. An insole platform for a welted article of footwear comprising:

an insole platform formed in the shape of a foot, said insole platform shaped to define an upwardly opening recess including a bottom wall;

a rib extending downwardly from said insole platform to define a downwardly opening platform recess, said rib adapted to affix a welt to said insole platform wherein said upwardly opening recess at least partially occupies a space within said downwardly opening platform recess.

2. The insole platform of claim 1 comprising a shank secured to said insole platform, wherein said shank extends substantially around said recess.

3. The insole platform of claim 1 comprising an insert including a footbed and a downwardly extending cushion element, said cushion element fitted at least partially within said recess.

4. The insole platform of claim 3 wherein said recess is formed in at least one of a heel and a forefoot of the foot of a wearer.

5. The insole platform of claim 2 wherein said shank is formed of polystyrene and said insole platform is formed of polyvinyl chloride.

6. The insole platform of claim 1 wherein said recess includes at least one side wall connected to said bottom wall.

7. The insole platform of claim 2 wherein said shank includes at least one shank wall extending along at least a portion of said side wall toward said bottom wall.

8. The insole platform of claim 7 wherein said shank wall and said side wall are inclined from vertical to center a wearer's foot within said recess.

9. A cushioning system for footwear comprising:

an insole platform including an insole plate corresponding to the shape of a human foot and having an underside, said insole plate defining a first recess bounded by a bottom wall, said insole platform further including an insole rib extending downwardly from said insole plate to define a second recess, said second recess at least partially surrounding said first recess on said underside;

an insert corresponding to the shape of a human foot including a cushion element extending from and positioned over said insole platform so that said cushion element fits substantially within said recess.

10. A sole assembly for a welted article of footwear comprising: an outsole including an upper surface;

a midsole secured to said outsole, said midsole of a sheet construction substantially covering said upper surface;

an insole platform secured to said midsole, said insole platform including a downwardly extending rib which defines a downwardly opening recess, said insole platform defining an upwardly opening recess bounded by one or more side walls and a bottom, at least a portion of said bottom in a position that is at least one of in and below said downwardly opening recess; and an insert including a footbed and a cushion extending from said footbed and interfit with said upwardly opening recess.

11. The sole assembly of claim 10 wherein said insole platform includes at least one of a heel and a forefoot, and wherein said upwardly opening recess is formed in at least one of the heel and the forefoot.

12. The sole assembly of claim 11 wherein said insert includes a heel cushion extending from said footbed and interfit within said upwardly opening recess formed in the heel.

13. The sole assembly of claim 11 wherein said insert includes at least one of a heel cushion and a forefoot cushion, said heel cushion including a plurality of downwardly extending ribs being forwardly inclined from the vertical, said forefoot cushion including a plurality of downwardly extending ribs and being rearwardly inclined from the vertical.

14. The sole assembly of claim 11 wherein said insert includes at least one of a heel cushion and a forefoot cushion of a solid cushion construction.

15. The sole assembly of claim 11 comprising a shank integrally secured to said insole platform around said upwardly opening recess formed in the heel.

16. The sole assembly of claim 15 wherein said shank includes at least one shank wall that extends adjacent said one or more side walls.

17. A sole assembly for a welted article of footwear comprising:

an outsole including an upper surface;

a midsole secured to said outsole, said midsole of a sheet construction substantially covering said upper surface;

an insole platform secured to said midsole, said insole platform defining a recess bounded by one or more side walls and a bottom;

an insert including a footbed and a cushion extending from said footbed and interfit with said recess; and wherein said outsole defines a cavity including at least one of a pad positioned in said cavity and a plug molded in said cavity.

18. A method for manufacturing a sole assembly for welted footwear comprising:

providing an insole platform including an insole heel portion, an insole forefoot portion, and an insole plate, said insole plate including a side wall extending downwardly from said insole plate on a first side of said insole plate and a bottom wall, said side wall and said bottom wall cooperating to define an upwardly opening recess below said insole plate on said first side, the insole platform further including a rib extending downwardly from said insole plate on said first side, said rib adapted to affix the insole platform to a welt;

securing the rib to a midsole; and securing at least one of the midsole and the insole platform to an outsole, the outsole including an outsole heel portion.

19. A method for manufacturing a sole assembly for welted footwear comprising:

providing an insole platform including an insole heel portion, an insole forefoot portion, and an insole plate defining an upwardly opening recess bounded by a bottom wall and at least one side wall, the insole platform further including a rib extending therefrom for affixing the insole platform to a welt;

securing the rib to a midsole of a sheet construction;

securing at least one of the midsole and the insole platform to an outsole, the outsole including an outsole heel portion; and wherein the outsole defines a heel cavity in the outsole heel portion, the heel cavity including at least one of a heel pad positioned in said heel cavity and a heel plug molded in said heel cavity.

20. The method of claim 19 wherein the midsole is substantially void of any perforations that correspond to the upwardly opening recess in the insole platform.

21. The method of claim 19 comprising disposing an insert over the insole platform the insert including a cushion, wherein the cushion is disposed in the recess.

22. The method of claim 18 wherein a shank is secured to the insole plate, the shank extending around the recess.

23. The method of claim 22 wherein insole platform is molded from polyvinyl chloride and the shank is molded from polystyrene.

* * * * *